US005694880A

United States Patent [19]

Gray et al.

[11] Patent Number: 5,694,880

[45] Date of Patent: Dec. 9, 1997

[54] DEVICE FOR TOWING A SAILBOARD

[76] Inventors: Timothy P. Gray, 35 Carriage Ct., Farmington, N.Y. 14425; Michael A. Kunes, 4403 Shortsville Rd., Shortsville, N.Y. 14548

[21] Appl. No.: 375,772

[22] Filed: Jun. 14, 1995

[51] Int. Cl.[6] ..... B63B 21/56

[52] U.S. Cl. ..... 114/249; 114/253; 441/65

[58] Field of Search ..... 441/65, 68, 69, 441/72, 73, 74; 114/242, 253, 254, 249, 250

[56] References Cited

U.S. PATENT DOCUMENTS 3,802,374 4/1974 Brown ..... 114/249

5,057,044 10/1991 Moore et al. ..... 441/69

5,163,860 11/1992 Clark ..... 441/65

5,367,972 11/1994 McCulloh ..... 114/242

*Primary Examiner*—Sherman Basinger

*Attorney, Agent, or Firm*—Cumpston & Shaw

[57] ABSTRACT

The power surfer is a simple device that is used to convert most of the wind driven sailboards or windsurfers being produced these days into a surfboard which can easily be pulled behind a boat or other type of watercraft.

4 Claims, 2 Drawing Sheets

DEVICE FOR TOWING A SAILBOARD

BACKGROUND OF THE INVENTION

1. Field of the Invention

This invention relates to surfboards which can easily be pulled behind a boat or other type of watercraft, and more particularly to a device that can be used to convert a wind driven sailboard or windsurfer into such a surfboard.

2. Description of the Prior Art

Most of today's windsurfers and sailboards, as shown in FIGS. 1 and 2, item 1, have a "track" that supports and allows for any adjustments to the mast of the sail assembly. These tracks are usually comprised of aluminum or plastic and mount into the windsurfer or sailboard itself. Although tracks made from these types of materials are strong enough to handle the weight of the mast and sail assembly, they are not durable enough to withstand the continuous force exerted when the sailboard or windsurfer is being pulled.

SUMMARY OF THE INVENTION

Therefore, an object of this invention is to provide a simple device that can be used to convert a wind driven sailboard or windsurfer into a surfboard which can easily be pulled behind a boat or other type of watercraft.

The device according to a preferred embodiment of the invention comprises an adapter for releasably connecting a water buoyant board to a tow rope and attached handle, the board having a track or recess, the adapter comprising:

(a) a mounting base for releasably engaging the track recess;

(b) a holder connected to the base, the holder sized to receive at least a portion of the handle, the holder having a substantially closed end, an open end and a rope slot extending from the open end, the holder sized to receive the handle such that the tow rope passes through the rope slot; and (c) an end cap for engaging the open end of the holder to enclose the portion of the handle intermediate of the closed end and the end cap, such that the tow rope passes through the rope slot.

DESCRIPTION OF THE PREFERRED EMBODIMENTS

Figure 1:
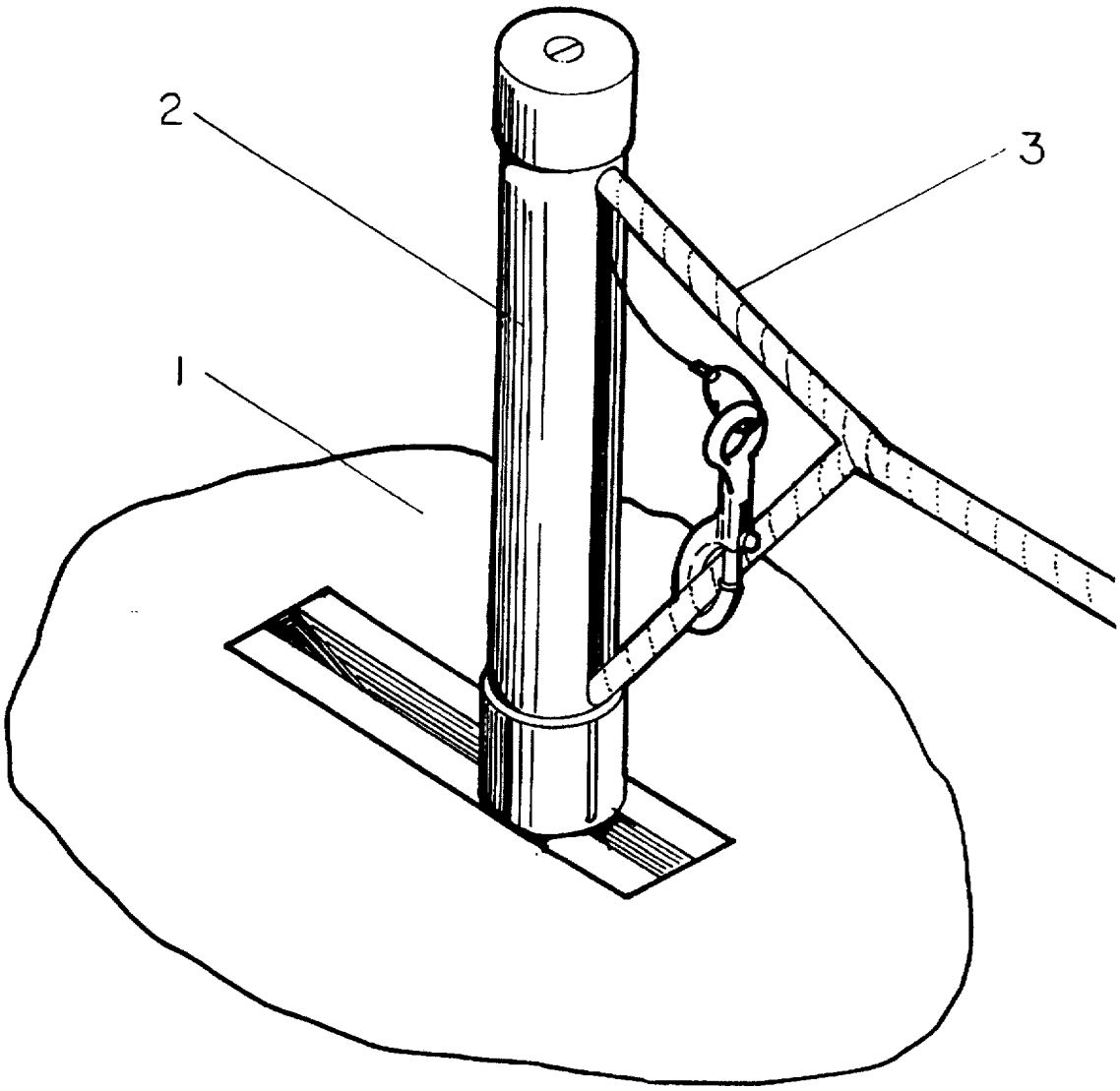
FIG. 1 is a perspective view of a standard water skiing rope attached to a water buoyant board.
Figure 2:
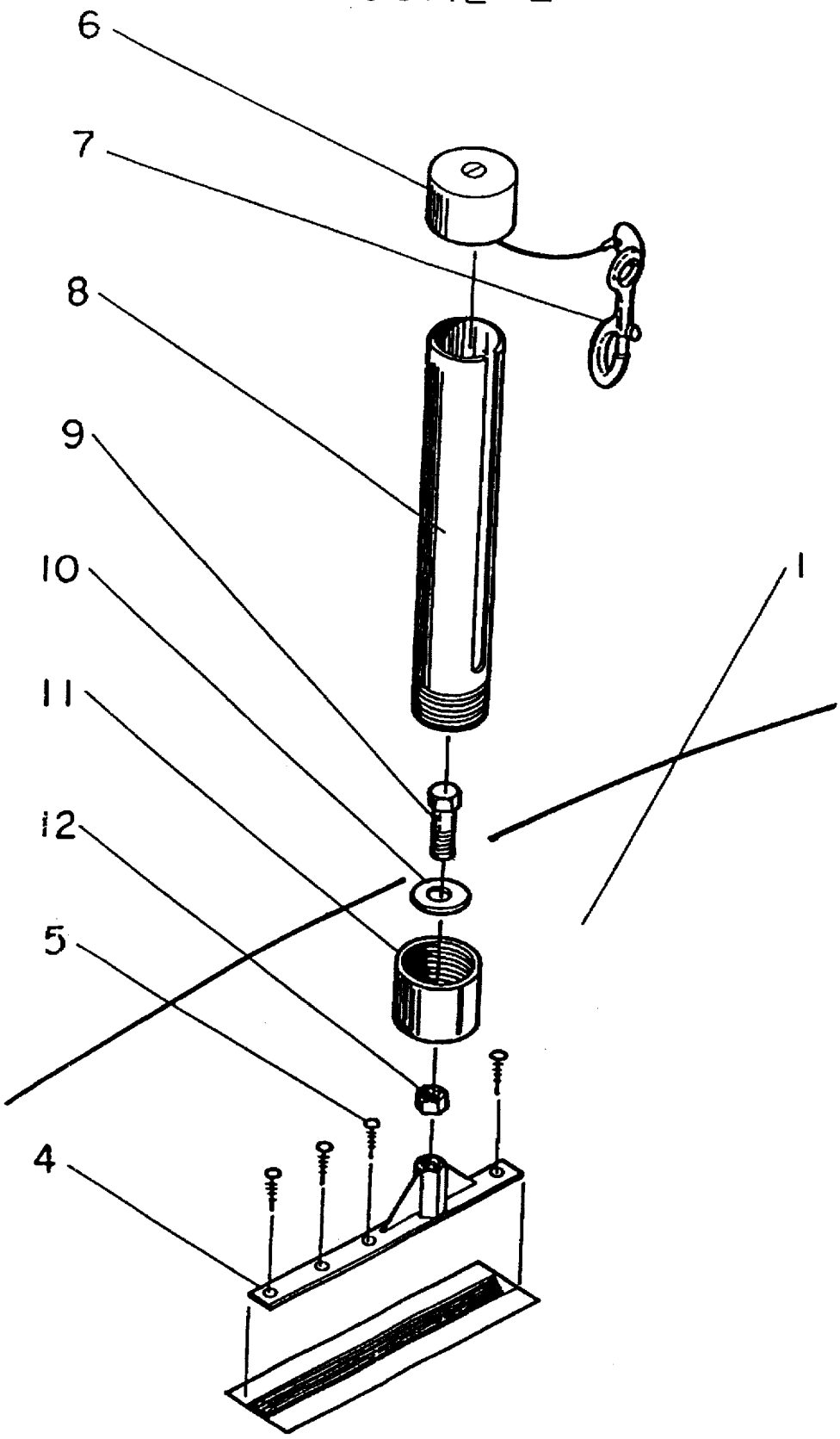
FIG. 2 is an exploded perspective view of a mounting base and interconnected components for connecting a water buoyant board to a water skiing rope.

As shown in FIGS. 1 and 2, the power surfer consists of a "mounting base" assembly 4 along with a "main body" assembly 2. As you can see from FIG. 1, the main body section of the power surfer is constructed so that the "D" or "T" handle of a standard water skiing rope 3 can easily be inserted into it. This unique design means that you do not have to make or buy a seperate or special tow rope just for the power surfer. Also, it should be noted that the rope coming back from the watercraft attaches directly to the sailboard or windsurfer (through the power surfer) to give the user a truer feeling of surfing rather than having to hold onto the tow rope or else a sail assembly. The power surfer comes with its own mounting base assembly 4 which makes use of the same track mounting screws to fasten it to the sailboard or windsurfer 1 once the track has been removed. FIG. 2 shows the mounting base assembly 4 of the power surfer along with the track mounting screws 5. The mounting base assembly 4 is made up of a piece of metal flat stock about one foot in length, ¾ of an inch in width and about ¼ of an inch thick. A one inch long coupling nut is placed on end onto the metal flat stock and welded so that the open end of the nut can accept the connecting bolt 9 of the main body assembly. Two triangle shaped metal "gussets" are then welded to both the coupling nut and the metel flat stock for added strength and support.

FIG. 2 also shows the construction of the main body assembly of the power surfer. Looking from top to bottom at the main body assembly's major components, you see that it consists of an upper cap 6, a slotted tube-shaped body 8 and a lower cap 11. The upper cap 6 is an unthreaded durable plastic (PVC) pipe cap with the purpose of holding the tow rope inside of the slotted tube-shaped body 8. Because the pipe cap does not float in water, one end of a short length of thin cable is attached to the cap and the other end of the cable uses a metal clip 7 to connect to the tow rope. Like the upper cap, the slotted tube-shaped body is also constructed of durable PVC plastic of the same pipe size as the cap. The tube-shaped body is threaded at its bottom so that it can be screwed into or out of the lower cap 11 of the power surfer. The lower cap is just like the upper cap except that the lower cap is threaded. A hole is drilled in the bottom of the lower cap to accomodate the connecting bolt 9 which is inserted and tightened into the connecting nut of the mounting base assembly. Finally, a locking nut 12 is placed on the connecting bolt and tightened down onto, the top of the coupling nut of the mounting base assembly to lock the two assemblies of the power surfer together.

We claim:

1. An adapter for releasably connecting a water buoyant board to a tow rope and an attached handle, the board having a track or recess, comprising:

(a) a mounting base for releasably engaging the track or recess;

(b) a holder connected to the base and immovable relative to the board when connected, the holder sized to receive the handle, the holder having a closed end, an open end and an uninterrupted rope slot extending from the open end to a position adjacent the closed end, the holder sized to receive the handle through the open end such that the rope slot is adapted to allow the tow rope to slide through the rope slot from the open end to the closed end; and (c) an end cap for engaging the open end of the holder, the holder adapted to enclose the portion of the handle intermediate of the closed end and the end cap.

2. An adapter for releasably connecting a water buoyant board to a tow rope and an attached handle, the board having a track or recess, comprising:

(a) a mounting base for releasably engaging the track or recess;

(b) a holder connected to the mounting base, the holder having a tubular wall and a rope slot formed in a side of the tubular wall, the rope slot allowing for unrestricted movement of a tow rope throughout the slot: and (c) a closure for releasably engaging the holder to form a retaining chamber and the rope slot, wherein the retaining chamber is sized to retain a portion of the handle and the rope slot is sized to preclude passage of the portion of the handle through the rope slot.

3. The adapter of claim 2, wherein the closure is a cap for engaging the holder to form the retaining chamber.

4. The adapter of claim 2 wherein the holder is threaded to threadingly engage the mounting base and is immovable relative to the mounting base and to the track or recess when engaged.

* * * * *